US005360286A

United States Patent [19]

Russell

[11] Patent Number: 5,360,286

[45] Date of Patent: Nov. 1, 1994

[54] HIGHWAY TRAFFIC BARRIER MADE FROM TIRES

[76] Inventor: Thomas W. Russell, 7312 Scarborough St., Springfield, Va. 22153

[21] Appl. No.: 985,257

[22] Filed: Dec. 3, 1992

[51] Int. Cl.[5] ..... E01F 13/00

[52] U.S. Cl. ..... 404/6; 404/9

[58] Field of Search ..... 404/6, 9; 49/6, 9; 52/DIG. 9, DIG. 7

[56] References Cited

U.S. PATENT DOCUMENTS 2,977,864 4/1961 Pullar ..... 52/DIG. 9
4,594,021 6/1986 Schäfer et al. ..... 404/14
5,118,216 6/1992 Smith ..... 404/6
5,122,008 6/1992 Drews ..... 404/6

*Primary Examiner*—Ramon S. Britts
*Assistant Examiner*—Pamela A. O'Connor
*Attorney, Agent, or Firm*—Edmund M. Jaskiewicz

[57] ABSTRACT

A highway safety traffic barrier comprises a plurality of strips cut from the treads of discarded motor vehicle tires and straightened to define substantially elongated members which are then assembled upon each other linearly, transversely or a combination of both. The assembled strips are bonded together to define an elongated impact absorbing structure having a predetermined cross-sectional shape. A process is also disclosed.

3 Claims, 2 Drawing Sheets

FIG. 1
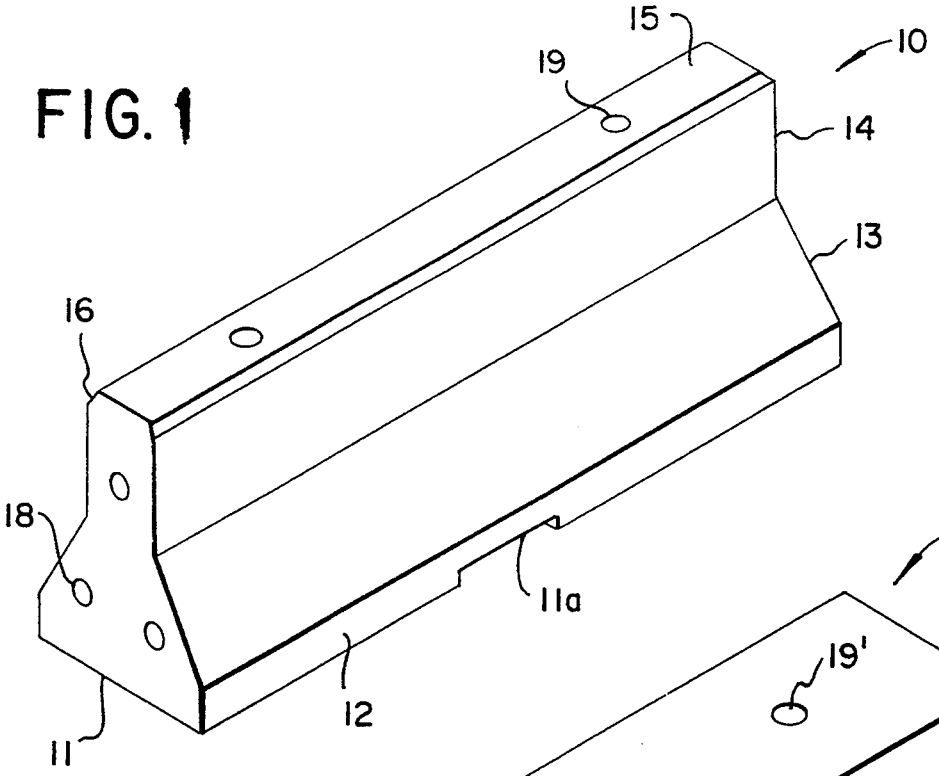
FIG. 2
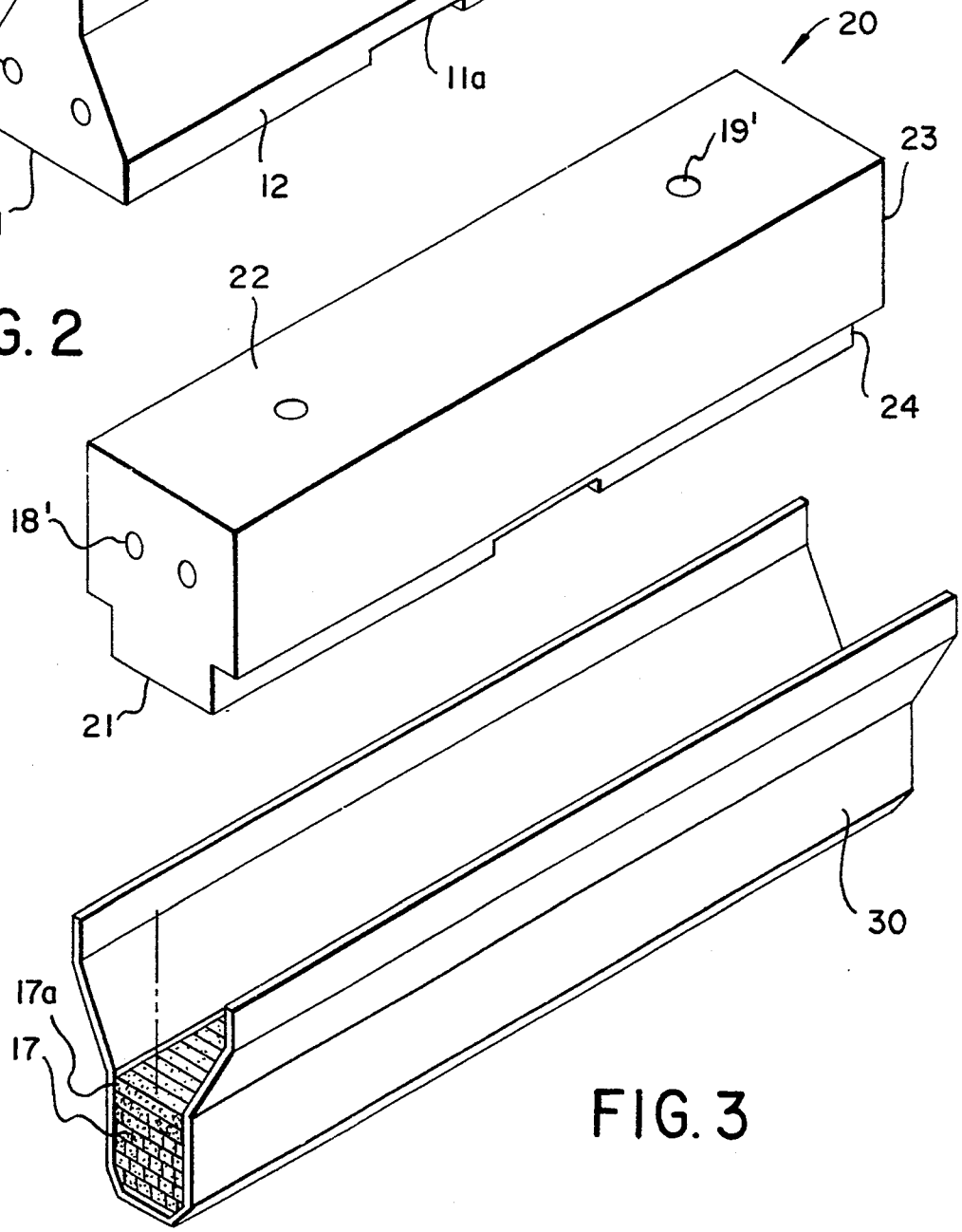
FIG. 3

HIGHWAY TRAFFIC BARRIER MADE FROM TIRES

The present invention relates to a highway traffic or safety barrier made from discarded motor vehicle tires, more particularly, to such a barrier which is formed from portions of discarded tires wherein the portions are bonded together so as to form a solid impact and kinetic energy absorbing structure.

Highway traffic barriers are commonly employed as safety devices to protect against roadside hazards or dangers and as traffic barriers to regulate or control the flow of traffic because of a temporary obstruction or hazard such as when repairs are being made to a road surface. A guard rail fence, commonly used as a permanent safety barrier, has the disadvantage of not absorbing the impact of a motor vehicle but actually causing the vehicle to rebound back into the flow of traffic. Further, at high speeds vehicles may jump guard rails or break the same, thereby significantly limiting the safety effect of such barriers. Accordingly, various forms of safety barriers have been proposed which are of a resilient nature so as to provide an energy absorbing barrier for a road hazard. However, such commonly proposed energy absorbing barriers usually have a complex and expensive structure so that these barriers have not been adopted for general use.

Traffic barriers which are intended to be a temporary protection against hazards have been constructed of concrete and are placed in the desired position and are intended to remain in such position because of their inherent weight. However, when a vehicle contacts one of such barriers the barrier will move sufficiently so as to absorb at least a portion of the kinetic energy generated by the moving vehicle. The solid structure of such a concrete barrier will cause significant damage to the vehicle and occasionally cause the vehicle to bounce back into traffic.

The use of discarded motor vehicle tires has been proposed in various forms to construct traffic or safety barriers for vehicles but such structures have not achieved any great use, again because of the complicated structure and relatively high cost. At the same time, the supply of discarded motor vehicle tires continues to increase and in many instances such discarded vehicle tires present significant environmental problems. Various structures which have been proposed in the past to utilize discarded vehicle tires usually involved expensive procedures for processing discarded tires such that the relatively low cost of such discarded tires is outweighed by the expensive processing costs. As a result, relatively little use has been made of discarded motor vehicle tires.

It is therefore the principal object of the present invention to provide a novel and improved highway traffic barrier made from discarded motor vehicle tires and a process for making the barriers.

It is another object of the present invention to provide a highway traffic barrier which is simple in construction, relatively inexpensive to make and which absorbs kinetic and impact energy.

It is a further object of the present invention to provide impact absorbing highway traffic barriers which are made from particular portions of discarded motor vehicle tires.

According to one aspect of the present invention, a highway safety traffic barrier may comprise a plurality of strips cut from the treads of discarded motor vehicle tires and straightened to define substantially elongated members which are then assembled upon each other in a linear or matrix arrangement or a combination of both and bonded together to define an elongated impact absorbing structure having a predetermined cross-sectional shape.

The strips may be cut radially across the tire so as to form a plurality of strips each having a length substantially equal to the circumference of the tire. As a modification, the tire may be cut substantially radially across but at a slight angle which produces a single helical strip from each tire.

The barrier may also comprise a plurality of circular components cut from discarded motor vehicle tires and stacked vertically upon each other and then bonded in this position to define a cylindrical impact absorbing structure. The circular components may comprise the sidewalls of tires or may comprise the tire beads.

When the traffic barrier is made from strips, the strips are then assembled into a mold having a predetermined shape and the assembled strips are then bonded together in the mold to form a solid impact absorbing structure. To carry out this process, suitable adhesive may be applied to the individual strips prior to assembly in the mold, or the strips may be assembled in the mold and then an adhesive introduced into the mold and the subsequent assembly subjected to pressure and heat to form the molded traffic barrier.

Other objects and advantages of the present invention will be apparent upon reference to the accompanying description when taken in conjunction with the following drawings, which are exemplary, wherein;

FIG. 1 is an overall perspective view of a highway safety barrier according to the present invention;

FIG. 2 is a view similar to that of FIG. 1 but showing a modification thereof;

FIG. 3 is an overall perspective view of a mold shape in which the strips are in a linear and matrix arrangement to form the barrier shown in FIG. 1;

Proceeding next to the drawings, wherein like reference symbols indicate the same parts throughout the various views, a specific embodiment and modifications of the present invention will be described in detail.

Figure 4:
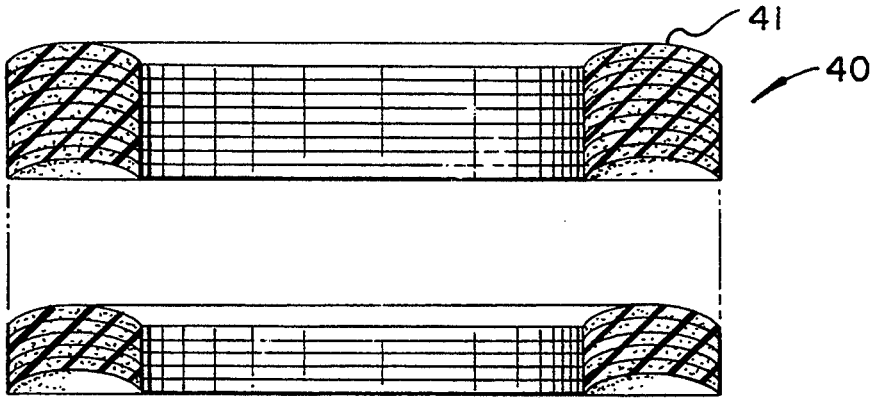
FIG. 4 is a vertical sectional view of still another modification of a barrier in which the barrier is formed from sidewalls of tires.

As may be seen in FIG. 1, there is indicated generally at 10 a highway safety or traffic barrier according to the present invention. Such a traffic barrier is generally about 10 feet long and the present embodiment comprises a base or bottom surface 11 and upstanding therefrom are base sidewalls 12. Sloping inwardly from the sidewalls 12 are sloping sidewalls 13 which connect with vertical sidewalls 14 extending upwardly to a top surface 15. The intersection between the top surface 15 and sidewalls 14 is beveled at 16.

The barrier 10 is formed from a plurality of linearly arranged strips shown in FIG. 3 at 17 and strips in a matrix or transverse arrangement shown at 17*a* which are bonded together with a suitable adhesive into the shape as shown in FIG. 1 or to any other predetermined shape as may be seen, for example, in FIG. 2.

Extending longitudinally through the barrier 10 are one or more longitudinal bores 18 which receive steel cables therethrough, which may be attached to end barrier units so as to anchor the barrier members in position.

The barrier 10 may also be provided with one or more vertical bores 19 to accommodate vertical posts which may be embedded in the ground and thus also provide an anchor for the barrier 10.

Figure 6:
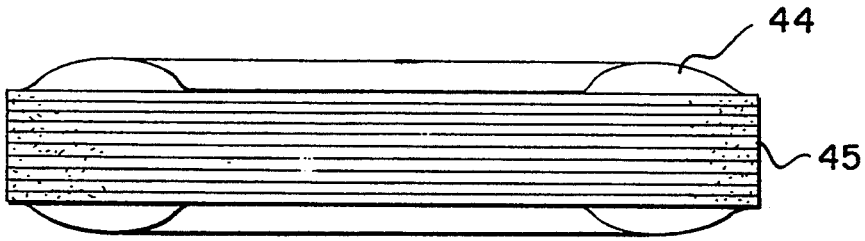
FIG. 6 is a plan view of a tire wherein the tread thereof is cut radially straight across to form strips.
Figure 7:
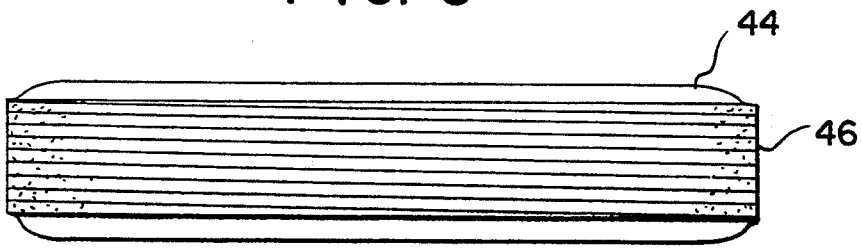
FIG. 7 is a view similar to that of FIG. 6 but wherein the tread of the tire is cut at a slight angle with respect to the radial axis to form a single helical strip.

The strips 17 and 17*a* from the tire tread may be cut in either of the processes as shown in FIGS. 6 and 7. In FIG. 6, the tread of a discarded motor vehicle tire 44 is cut radially straight across, sidewall to sidewall, at 45 to form a plurality of one-half to one and one-half inch wide strips each of which has a length substantially equal to the circumference of the tread of the tire.

The strips 17 may also be cut as illustrated in FIG. 7 wherein a single cut 46 is made straight across the tire, but is at a slight diagonal to the radial axis of the tire. The result is a strip approximately one-half to one and one-half inches wide which is in the form of a single helical member. This helical strip may in turn be cut into strips of the proper lengths for forming the barrier, either in a linear or matrix arrangement.

The bottom surface 11 of the barrier 10 is provided with a transverse slot or recess 11*a* in order to provide for the drainage of any water accumulating behind one of these barriers.

As may be seen in FIG. 2, there is indicated generally at 20 a traffic barrier which has a cross-sectional shape different from that shown in FIG. 1. The barrier 20 has substantially a rectangular shape with a base 21 and a top 22 and sidewalls 23. The lower portions of each sidewall 23 adjacent to the bottom surface is undercut to a height of 10–12 inches and inwardly about 4 inches as shown at 24. This undercut portion is for the purpose of accommodating the hubs of the wheels of motor vehicles which may contact this barrier 20. The barrier 20 is provided with one or more longitudinally extending bores 18' to accommodate steel cables and with one or more vertical bores 19' to accommodate vertical fence posts.

The elongated traffic barriers of FIGS. 1 and 2 are both constructed in the same manner, but with the use of different shaped molds. As may be seen in FIG. 3, there is shown a mold 30 which is used for the making of barrier 10 shown in FIG. 1.

The strips 17, which have been cut from the treads of motor vehicle tires as shown in FIGS. 6 and 7, are cut to the appropriate length according to the mold and strip arrangement. The edges of the strips 17 are new rubber and the tops and bottoms of each strip are then abraded in a roughing mill to expose new rubber. A suitable adhesive which may be ELASTOLOCK 2705 and 2995, both epoxies, by B. F. Goodrich or a cold vulcanizing fluid as produced by the Rema Tip Top Corporation of Germany is then applied to all sides of the strips. The strips are then laid into the mold 30 as shown in FIG. 3, in a linear and matrix arrangement, and pressure and heat applied as required. The entire structure is then cured and removed from the mold. If desired, tire crumbs mixed with adhesive are spread over the exterior surface to provide a finish thereto. Tire crumbs are merely ground up portions of vehicle tires having a particle size of about that of ordinary table salt.

The barriers 10 and 20 may be constructed with all the strips in a linear arrangement as at 17, with all the strips in a matrix or transverse arrangement as at 17*a*, or with a combination of alternating arrangements or layers of strips in linear and matrix arrangements.

In FIG. 4 there is shown a further modification wherein the safety barrier is in the form of a cylinder and is indicated generally at 40. This cylinder is formed from a plurality of sidewalls from tires from which the treads and beads have been removed. The sidewalls 41 are then stacked vertically on each other in a nesting position and the underside of each sidewall has an adhesive thereon such that the entire vertical assembly of sidewalls will adhere to each other to form a cylindrical member 40.

Figure 5:
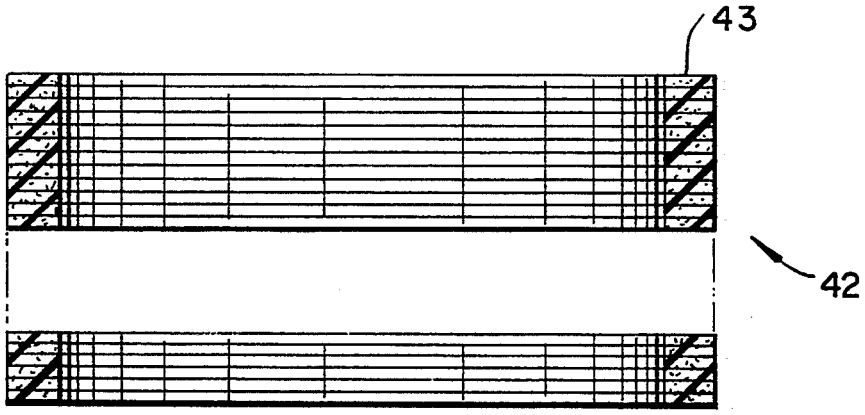
FIG. 5 is a vertical sectional view of a further modification of a barrier as shown in FIG. 4 wherein the barrier is formed from the beads of tires.

At FIG. 5, there is shown at 42 a second form of cylindrical highway barrier formed from a plurality of tire beads 43. The beads which have been cut frown the sidewalls are then stacked vertically upon each other and also glued to each other to form a cylindrical barrel of a desired height.

While the cylindrical highway barriers of FIGS. 4 and 5 have been described with their contemplated use of being in a vertical position, these barriers can also be used in a horizontal position and made of a suitable length.

It is thus apparent that the elongated structures of FIGS. 1 and 2 are relatively solid structures but which have sufficient resiliency so as to absorb impact and kinetic forces. Further, these barriers make effective use of the treads of discarded motor vehicle tires. Motor vehicles also include trucks, tractors, motorcycles and any other size of motor vehicle tires.

The cylindrical barriers of FIGS. 4 and 5 make use of the remaining sidewalls and treads of the discarded tires. Thus, the complete discarded tire structure is utilized to form a simple and effective traffic safety barrier which can be produced at a relatively low cost.

It will be understood that this invention is susceptible to modification in order to adapt it to different usages and conditions, and accordingly, it is desired to comprehend such modifications within this invention as may fall within the scope of the appended claims.

What is claimed is:

1. A highway safety device for use as a barrier on a roadway comprising a plurality of strips cut from the treads of motor vehicle tires and straightened to define substantially elongated members which are assembled upon each other to define an elongated structure having a predetermined cross-sectional shape, all of said strips being disposed in a linear arrangement and each of said strips has a length equal to the length of the elongated structure, and means bonding said assembled strips together into a solid impact absorbing structure which has high resistance to shear forces to redirect vehicles impacting on said structure, the exterior surface of said barrier being solely defined by tread material of motor vehicle tires.

2. A highway safety device for use as a barrier on a roadway comprising a plurality of strips cut from the treads of motor vehicle tires and straightened to define substantially elongated members which are assembled upon each other to define an elongated structure having a predetermined cross-sectional shape, all of said strips being disposed in transverse arrangement and each of said strips has a length equal to the width of the elongated structure, and means bonding said assembled strips together into a solid impact absorbing structure which has high resistance to shear forces to redirect vehicles impacting on said structure, the exterior surface of said barrier being solely defined by tread material of motor vehicle tires.

3. A highway safety device for use as a barrier on a roadway comprising a plurality of strips cut from the treads of motor vehicle tires and straightened to define substantially elongated members which are assembled upon each other to define an elongated structure having a predetermined cross-sectional shape, said strips being disposed in both linear and transverse arrangements, the linear disposed strips each having a length equal to the length of the elongated structure and the strips disposed transversely each having a length equal to the width of the elongated structure, and means bonding said assembled strips together into a solid impact absorbing structure which has high resistance to shear forces to redirect vehicles impacting on said structure, the exterior surface of said barrier being solely defined by tread material of motor vehicle tires.

* * * * *